US007870834B1

(12) United States Patent
Cundiff

(10) Patent No.: US 7,870,834 B1
(45) Date of Patent: Jan. 18, 2011

(54) ROTATABLE WORKPIECE PAINTER'S STAND

(76) Inventor: Dwight D Cundiff, 830 27th Ave., Vero Beach, FL (US) 32960

( * ) Notice: Subject to any disclaimer, the term of this patent is extended or adjusted under 35 U.S.C. 154(b) by 824 days.

(21) Appl. No.: 11/781,111

(22) Filed: Jul. 20, 2007

(51) Int. Cl.
*B05C 13/02* (2006.01)

(52) U.S. Cl. ..... 118/500; 118/502; 118/503; 248/201; 248/166; 248/188.7; 248/291.1; 269/17; 269/905

(58) Field of Classification Search ..... 118/500, 118/502, 503; 248/201, 166, 188.7, 291.1; 269/905, 17; 434/419
See application file for complete search history.

(56) References Cited

U.S. PATENT DOCUMENTS

| | | | | | |
|---|---|---|---|---|---|
| 121,801 | A | * | 12/1871 | Moritz | 118/502 |
| 855,219 | A | * | 5/1907 | Anthony, Jr. | 118/502 |
| 1,053,613 | A | * | 2/1913 | Klingman | 118/502 |
| 1,084,504 | A | * | 1/1914 | Thayer | 118/502 |
| 2,599,010 | A | * | 6/1952 | Pernitz | 269/55 |
| 2,955,632 | A | * | 10/1960 | Stone | 269/17 |
| 2,997,292 | A | * | 8/1961 | Lucker et al. | 269/17 |
| 4,239,197 | A | * | 12/1980 | Olstad | 269/68 |
| 4,577,843 | A | * | 3/1986 | Milwain | 269/51 |
| 5,090,648 | A | * | 2/1992 | Wood, IV | 248/125.3 |
| 5,551,980 | A | * | 9/1996 | Turnbo | 118/500 |
| 6,034,348 | A | * | 3/2000 | Kim et al. | 219/121.68 |
| 6,090,204 | A | * | 7/2000 | Speed et al. | 118/500 |

FOREIGN PATENT DOCUMENTS

| | | | |
|---|---|---|---|
| JP | 20050522823 | * | 3/2005 |
| WO | WO0160528 | * | 8/2001 |

* cited by examiner

*Primary Examiner*—Laura Edwards
(74) *Attorney, Agent, or Firm*—Michael I Kroll

(57) ABSTRACT

A painters stand comprising a pair of extensible supports for rotatably securing a workpiece therebetween. Each support is comprised of a stanchion having a collar mounted thereon with a plurality of divergent legs extending therefrom with the stanchion having an intermediate workpiece support approximate the top end and a receiver for a workpiece fastener that will be fastened to a workpiece end whereby the workpiece can be supported between the stanchions. Once mounted in the workpiece receiver a plurality of radially positioned apertures are provided within the workpiece fastener so that one can be selectively co-aligned with a workpiece receiver aperture for insertion of a pin to secure the workpiece while a desired operation is performed, such as sanding and or painting.

8 Claims, 10 Drawing Sheets

ROTATABLE WORKPIECE PAINTER'S STAND

BACKGROUND OF THE INVENTION

1. Field of the Invention

The present invention relates generally to supports and, more specifically, to a painters stand comprising a pair of extensible supports for rotatably securing a workpiece therebetween. Each support is comprised of a stanchion having a collar mounted thereon with a plurality of divergent legs extending therefrom with the stanchion having an intermediate workpiece support approximate the top end and a receiver for a workpiece fastener that will be fastened to a workpiece end whereby the workpiece can be supported between the stanchions. Once mounted in the workpiece receiver a plurality of radially positioned apertures are provided within the workpiece fastener so that one can be selectively co-aligned with a workpiece receiver aperture for insertion of a pin to secure the workpiece while a desired operation is performed, such as sanding, painting, etc.

The painters' stand of the present invention provides that the stand can be used by a single individual with the provision of the aforementioned intermediate support. The workpiece fasteners are attached to opposing ends of the workpiece whereupon one end of the workpiece fastener is raised and supported on an intermediate workpiece support while the other end is raised and placed within the other intermediate support or the user can simply pick up the workpiece with attached workpiece fasteners and place both fasteners within their respective intermediate supports. The point being that the stanchion workpiece receiver is substantially tubular and the workpiece fastener having a corresponding tubular arm for insertion into the tubular receiver requires approximate alignment to insert one into the other. Therefore an intermediate support comprising an open hook-like support is provided near each of the workpiece fastener receivers for temporary support of the workpiece fasteners and attached workpiece while each end is matingly engaged.

2. Description of the Prior Art

There are other support devices designed for holding workpieces. Typical of these is U.S. Pat. No. 121,801 issued to Moritz on Dec. 12, 1871.

Another patent was issued to Anthony, Jr. on May 28, 1907 as U.S. Pat. No. 855,219. Yet another U.S. Pat. No. 1,053,613 was issued to Klingaman on Feb. 18, 1913 and still yet another was issued on Jan. 13, 1914 to Thayer as U.S. Pat. No. 1,084,504.

Another patent was issued to Pernitz on Jun. 3, 1952 as U.S. Pat. No. 2,599,010. Yet another U.S. Pat. No. 2,997,292 was issued to Lucker, et al. on Aug. 22, 1961. Another was issued to Milwain on Mar. 25, 1986 as U.S. Pat. No. 4,577,843 and still yet another was issued on Feb. 25, 1992 to Wood, IV as U.S. Pat. No. 5,090,648.

Another patent was issued to Turnbo on Sep. 3, 1996 as U.S. Pat. No. 5,551,980. Yet another U.S. Pat. No. 6,090,204 was issued to Speed, et al. on Jul. 18, 2000. Another was issued to Herwig on Aug. 23, 2001 as International Patent Application No. WO 01/60528 and still yet another was issued on Mar. 3, 2005 to Nakamori as Japan Patent No. JP2005052823.

U.S. Pat. No. 121,801

Inventor: David Moritz

Issued: Dec. 12, 1871

The invention discloses an apparatus for holding doors, blinds, shutters, and other things suspended in convenient position to be painted on both sides and at the edges without requiring one side to be dried before the other can be painted comprising a trestle having swivel-holders to secure a door, shutter, or other article at the ends, permitting it to be turned and locked in either position for painting.

U.S. Pat. No. 855,219

Inventor: Joseph S. Anthony, Jr.

Issued: May 28, 1907

A device comprising a pair of frames, an adjustable connection therebetween whereby said frames may be spaced at selected distances from one another, a rigid spur member carried centrally of one of said frames, two hinged spurs carried by the other of said frames and pointing oppositely to said first named spur, a spring pressed yoke engaging each of said last named spurs, and means for retaining said last named spur at selected positions about their pivots.

U.S. Pat. No. 1,053,613

Inventor: George Ellis Klingman

Issued: Feb. 18, 1913

The combination with a painter's table of upright frames thereon, a workholder carried by one of said frames, a revoluble shaft carried by the other of said frames, means for locking said shaft stationary, a spring pressed work holder on said shaft, and a cam on said shaft operating to move said workholder against the tension of its spring into operative position.

U.S. Pat. No. 1,084,504

Inventor: Fred N. Thayer

Issued: Jan. 13, 1914

A supporting device including uprights having bearings, shafts supported for rotation in the bearings, one of said shafts being slidable and spring actuated in the direction of the other shaft, a sleeve on one shaft, barbed cross bars on said sleeve and on the opposite shaft, and a crank on one of the shafts.

U.S. Pat. No. 2,599,010

Inventor: Kalman Pernitz

Issued: Jun. 3, 1952

A work holder comprising a U-shaped clamp, said clamp being formed of two extensibly connected tubular L-shaped members, means on one of said L-shaped members for rotatably suspending said clamp and a work piece therein from a support, work-clamping screws which are axially aligned with respect to each other and carried at the ends of the clamp for engaging the side edges of the work piece, means for releasably locking said members in selected positions to vary the distance between said screws, a collar slidably and rotatably carried by one of said L-shaped members, means carried by the collar and holding the same in slidable and rotatably adjusted position on said one member, and a stop carried by the collar and including a pair of resilient arms having free end portions adapted to contact the workpiece on one surface thereof to prevent rotative movement of the work piece about the axis of said screws.

U.S. Pat. No. 2,997,292

Inventor: Millard B. Lucker, et al.

Issued: Aug. 22, 1961

A boat jacking system comprising first and second jack units respectively detachably connectable to stern and bow portions of a boat, each of said jack units including a base, an upstanding strut supported by said base, load lifting means movable along said strut, actuating means connected with said load lifting means for shifting the load lifting means along said strut, single means supported by the load lifting means for rotation about a horizontal axis extending forwardly of said load lifting means, and single means carried by said rotatable means and detachably connectable with a boat so as to permit pivotal movement of a raised boat about a horizontal axis extending between said jack units.

U.S. Pat. No. 4,577,843

Inventor: Donald R. Milwain

Issued: Mar. 25, 1986

An apparatus for adjustably supporting a vehicle door at a convenient height whereby the door can be rotated through a generally horizontal axis passing through the door to a desired work position. The support apparatus comprises a pair of spaced-apart stands, one stand having mounting means in the form of an elongated connector pivotally secured thereto on a rotatable axle and adapted to be secured to one edge of the door by means of bolts threaded into bolt holes normally used for securement of the door hinges, and the other stand having a horizontal spindle secured thereto adapted to be received in the closable recess of the door locking mechanism on the opposite edge of the door for rotation of the door about the spindle. Each of the stands is adjustable as to height whereby the axis of the spindle and the axis of rotation of the axle secured to the elongated connector can be normally horizontally aligned.

U.S. Pat. No. 5,090,648

Inventor: William R. Wood, IV

Issued: Feb. 25, 1992

A stand assembly is provided for rotationally holding a door, window frame, or the like, for painting purposes. Pivot points are provided on the base and an extension contact with respective ends of the object to be held in the assembly. All surfaces of the object are exposed for painting when held and the object may be pivotally rotated during the painting. The assembly may be provided in a collapsible format.

U.S. Pat. No. 5,551,980

Inventor: James R. Turnbo

Issued: Sep. 3, 1996

An upright support member includes at least one laterally extending arm at the upper end thereof. This arm supports upright rails having adjustable hanger brackets thereon. The hanger brackets support door support plates capable of having doors to be treated mounted thereon by hinges whereby the door can be treated on both sides by hinged movement of the door. The door mounting plate can have screw holes that match hinge screw holes whereby to provide substitute hinges for supporting the doors thereon. By means of such structure, a process of painting a series of doors is available wherein the doors are disconnected from their hinges, the hinges being left on the cabinets. Door matching hinges are used and according to the system care does not have to be taken for painting the hinges.

U.S. Pat. No. 6,090,204

Inventor: Richard Lewis Speed, et al.

Issued: Jul. 18, 2000

Support fixtures to aid in painting or otherwise finishing doors is disclosed. When four of these support fixtures are attached to the end corners of a door they support the door above the adjacent surface and the door can be turned using the attached handles. This allows all desired surfaces of the door to be finished at one time. A second door similarly equipped with these support fixtures can be likewise finished and then stacked on top of the first door with the finished surfaces of both doors maintained apart. These support fixtures are portable and reuseable.

International Patent Application Number WO 01/60528

Inventor: Gernot Herwig

Issued: Aug. 23, 2001

According to the method, motor vehicle bodies (10) are turned about an axis in order to paint the surfaces which have different inclinations. This allows all the surfaces of motor vehicle bodies (10), irrespective of their inclination, to be painted using the same type of application device (26, 28) and the same type of application machine (18, 20, 22, 24).

Japan Patent Number JP 2005052823

Inventor: Yasuhito Nakamori

Issued: Mar. 3, 2005

PROBLEM TO BE SOLVED: To provide a stage apparatus for a table coater which can prevent the occurrence of application nonuniformity by minute vibration. SOLUTION: In the stage apparatus, a nozzle part 60 is transported uniaxially above a substrate table 30 arranged on a stone surface plate 20 installed on a frame 10 by a slider. The slider includes two Y-axis driving mechanisms 40A and 40B by two linear motors having movable parts which can travel along two rail parts 21A and 21B installed to extend uniaxially in parallel with each other on both sides of the stone surface plate. The yoke part of each linear motor is arranged along the rail parts through arm parts 11A and 11B extending uniaxially which are set to be separated structurally from the stone surface plate, and at least one vibration removing unit 25 is installed between the frame and the stone surface plate.

While these supports may be suitable for the purposes for which they were designed, they would not be as suitable for the purposes of the present invention, as hereinafter described.

SUMMARY OF THE PRESENT INVENTION

A primary object of the present invention is to provide support for a workpiece whereby substantially all of the surfaces are accessible for workpiece processing.

Another object of the present invention is to provide workpiece support wherein the workpiece can be rotatively moved and fixed at a provided angle during processing of the workpiece.

Yet another object of the present invention is to provide workpiece supports that are easily used by a single user.

Still yet another object of the present invention is to provide a pair of workpiece supports with each having a stanchion with a collar having divergent legs extending therefrom.

Another object of the present invention is to provide each of the workpiece supports with an intermediate workpiece support comprising an open hook-like member whereby said workpiece supports can be used by a single user.

Yet another object of the present invention is to provide workpiece fasteners that are releasably fastened to a workpiece prior to mounting within the workpiece supports.

Still yet another object of the present invention is to provide workpiece fasteners having an exteriorly extending arm for mounting to a respective workpiece support.

Another object of the present invention is to provide workpiece supports wherein said mounted workpiece can be rotated and pinned to a provided angle while work is performed on the workpiece.

Additional objects of the present invention will appear as the description proceeds.

The present invention overcomes the shortcomings of the prior art by providing a painters stand comprising a pair of extensible supports for rotatably securing a workpiece therebetween. Each support is comprised of a stanchion having a collar mounted thereon with a plurality of divergent legs extending therefrom with the stanchion having an intermediate workpiece support approximate the top end and a receiver for a workpiece fastener that will be fastened to a workpiece end whereby the workpiece can be supported between the stanchions. Once mounted in the workpiece receiver a plurality of radially positioned apertures are provided within the workpiece fastener so that one can be selectively co-aligned with a workpiece receiver aperture for insertion of a pin to secure the workpiece while a desired operation is performed, such as sanding and or painting.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
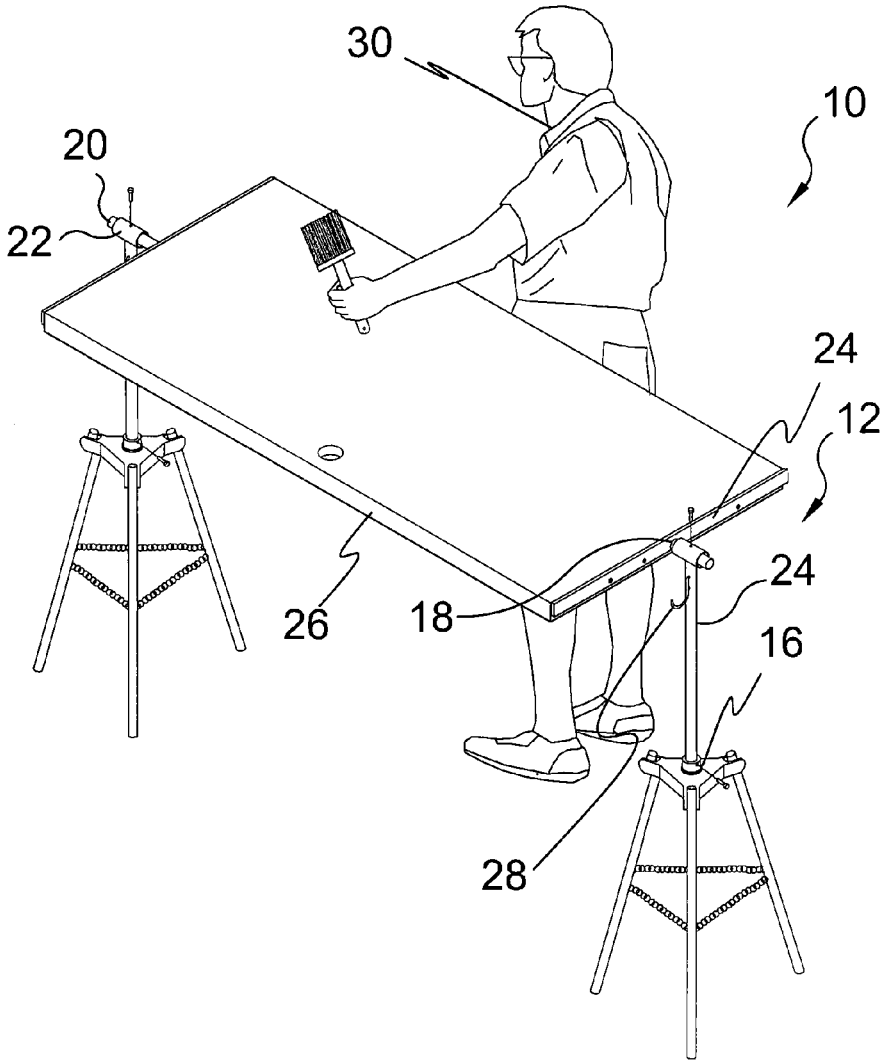
FIG. 1 is an illustrative view of the present invention in use.

Turning now descriptively to the drawings, in which similar reference characters denote similar elements throughout the several views, the figures illustrate the Rotative Painters Stand of the present invention. With regard to the reference numerals used, the following numbering is used throughout the various drawing figures.

10 Rotative Painters Stand of the present invention
12 adjustable holding stand
14 stanchion of 12
16 tripod
18 door attachment bracket
20 mounting post of 18
22 mounting ring of 20
24 door mounting plate of 18
26 door
28 support hanger
30 user
32 tripod leg
34 locking pin
36 locking pin aperture
38 screw
40 screw recesses
42 collar of 16

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the user 30 utilizing a rotative painters stand 10 consisting of two separate, adjustable holding stands 12 having a main stanchion 14 with three supporting tripod legs 16. Each stand 12 has a door attachment bracket 18 that has a mounting post 20 that is inserted into a mounting ring 22 disposed on the top of each main support post 14 and door mounting plates 24 that attach to the top and bottom portion of a door 26 prior to installing into the stand. Each stand 12 also having a support hanger 28 for placement of a door 26 and bracket to rest in as one side is inserted into the stand. Once a door 26 is installed to the stand, the door 26 can be rotated 360 degrees or as desired.

Figure 2:
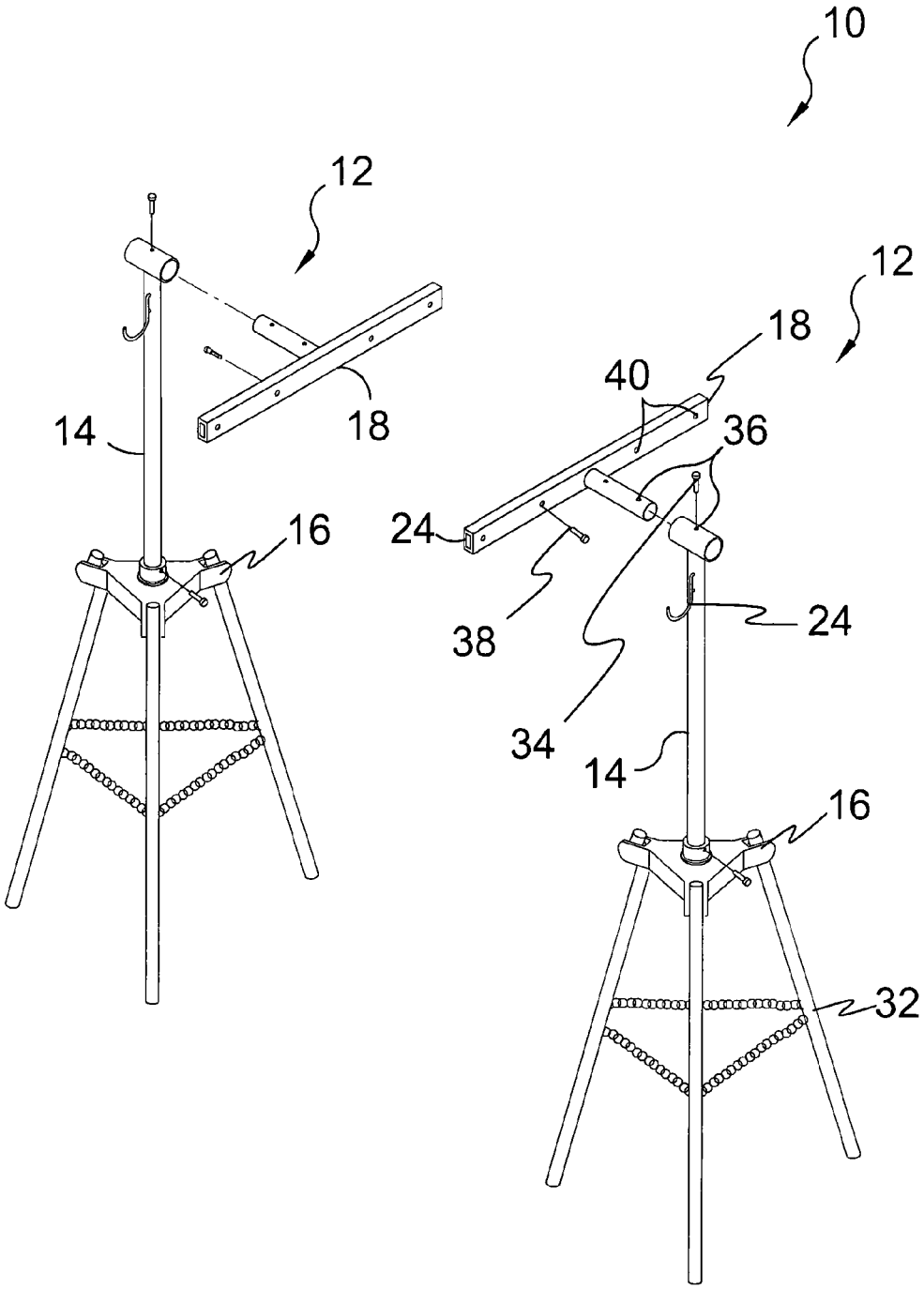
FIG. 2 is a perspective view of the present invention.

FIG. 2 is a perspective view of the present invention 10. Shown is the painters stand 10 consisting of two separate, adjustable holding stands 12 having a stanchion 14 having a tripod 16 with three legs 32. Each stand 12 has a rotative door attachment bracket 18 that is attached to the top and bottom portion of a door prior to installing into the stand. The mounting bracket 18 comprises a substantially flat, elongate mounting plate 22 having a plurality of screw recesses 40 disposed therein and a mounting post 20 projecting centrally therefrom. The mounting posts 20 are inserted into mounting rings 22 disposed on top of the stanchion 14 of each holding stand 12. Once the top and bottom of the door are secured to their respective mounting plates 24 with screws 38, the door may be rotated in position by the user and retained there by inserting a locking pin 34 into aligned locking pin apertures 34 disposed in the mounting post 20 and the mounting ring 22. Each stand 12 also has a support hanger 28 for placement of a door and bracket to rest in as one side is inserted into the stand 12. Once a door is installed to the stand 12, the door can be rotated 360 degrees or as desired.

Figure 3:
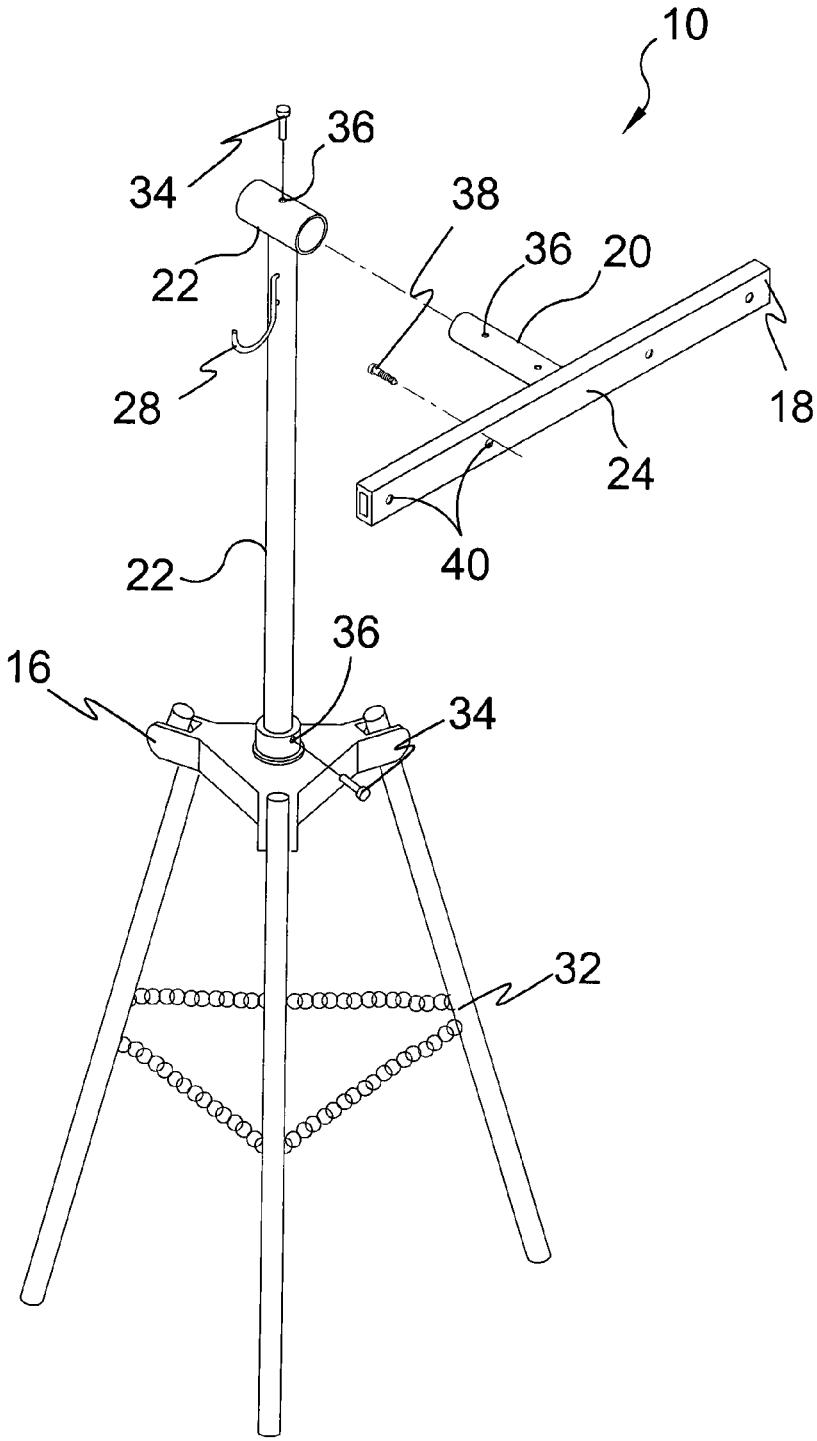
FIG. 3 is a detailed perspective view of one stand of the present invention.

FIG. 3 is a detailed perspective view of one stand of the present invention 10. Shown is the present invention 10 comprising a pair of holding stands 12 having a stanchion 14 with a tripod 16 having three legs 32. Each stand 12 has a door attachment bracket 18 that is attached to the top and bottom portion of a door prior to installing into the stand. The mounting bracket 18 comprises a substantially flat, elongate mounting plate 22 having a plurality of screw recesses 40 disposed therein and a mounting post 20 projecting centrally therefrom. The mounting posts 20 are inserted into mounting rings 22 disposed on top of the stanchions 14 of each holding stand 12. Once the top and bottom of the door are secured to their respective mounting plates 24 with screws 38, the door may be rotated in position by the user and retained there by inserting a locking pin 34 into aligned locking pin apertures 34 disposed in the mounting post 20 and the mounting ring 22. Each stand 12 also having a support hanger 28 for placement of a door and bracket to rest in as one side is inserted into the stand 12. Once a door is installed to the stand 12, the door can be rotated 360 degrees or as desired.

Figure 4:
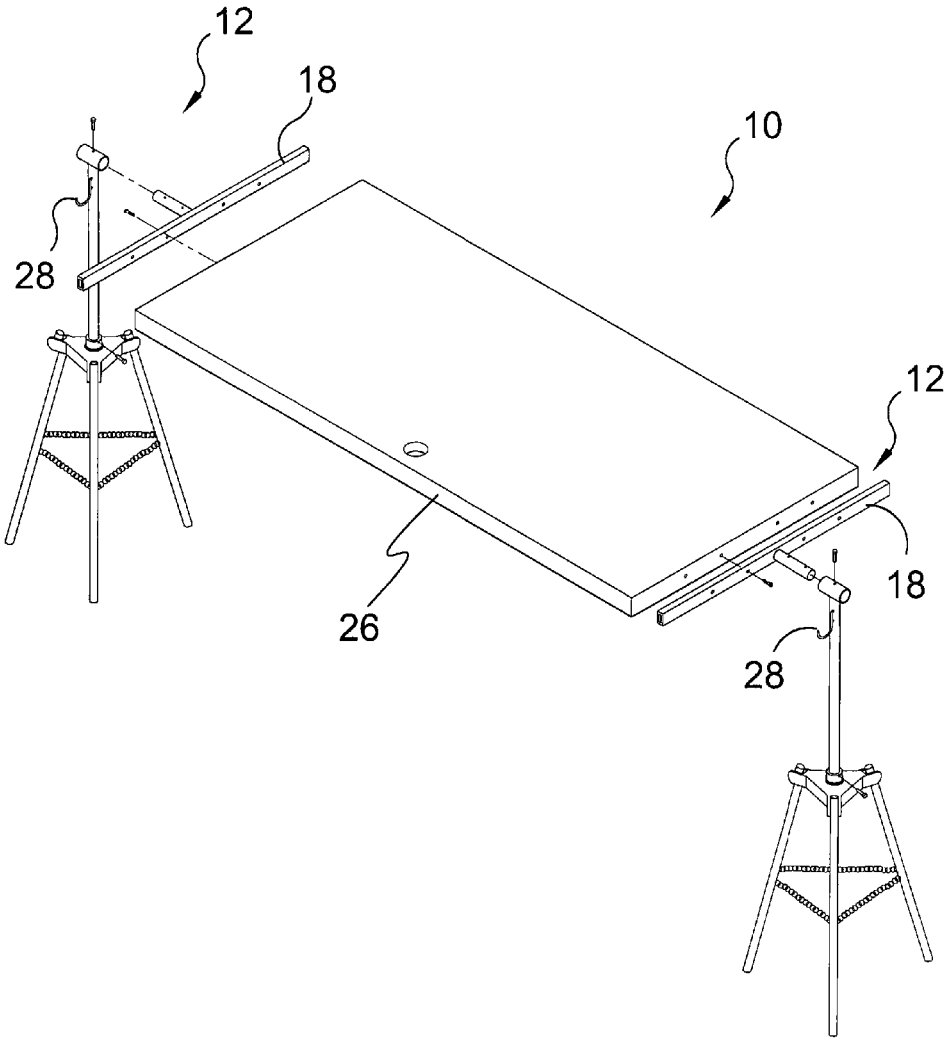
FIG. 4 is a perspective view of the present invention.

FIG. 4 is a perspective view of the present invention 10. Shown is the present invention having two holding stands 12, each having a door attachment bracket 18 about to be installed on the top and bottom portion of the door 26.

Figure 5:
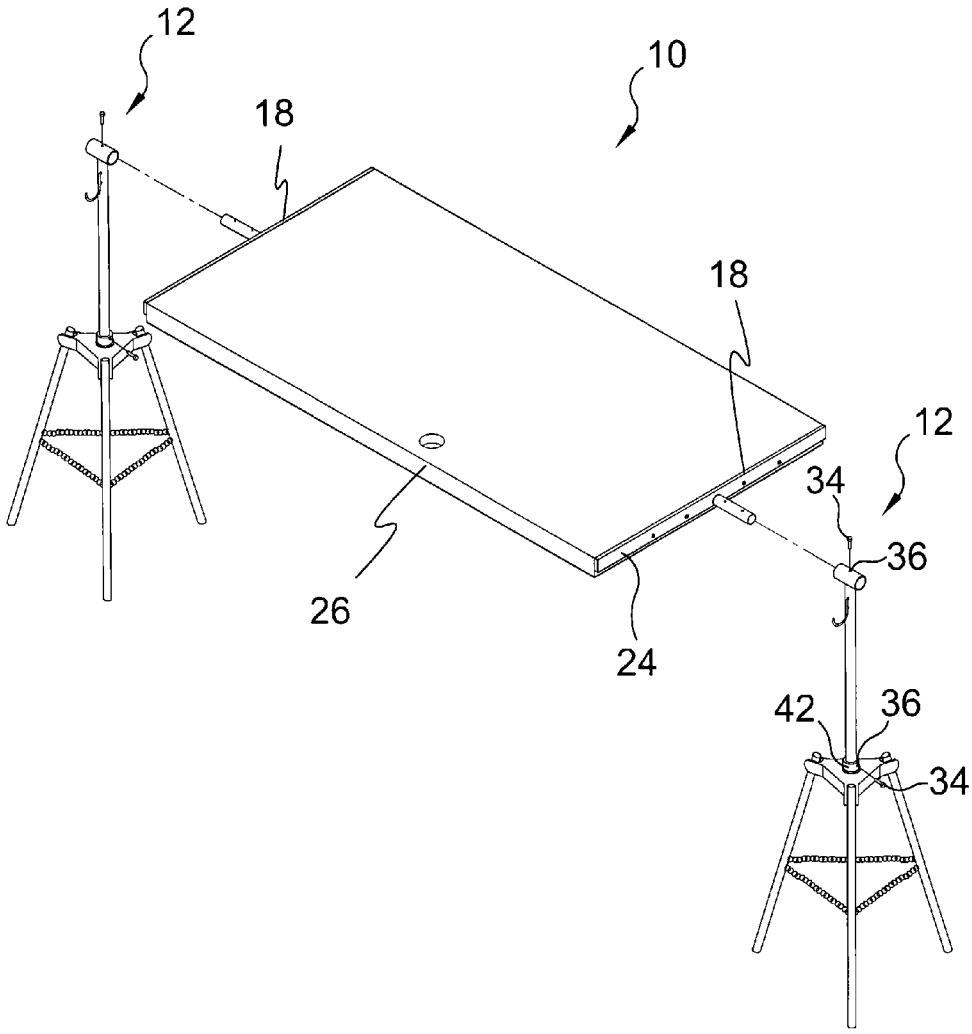
FIG. 5 is a perspective view of the present invention.

FIG. 5 is a perspective view of the present invention 10. Shown is the present invention 10 with the two mounting plates 24 of the door attachment brackets 18 installed on the top and bottom portions of the door 26 and ready to be secured to their respective holding stands 12. The stanchion 14 slides within the collar 16 of the tripod 16 and locking pins 34 and apertures 36 are also included therewith to secure the stanchion 14 to the tripod 16 at the appropriate height.

Figure 6:
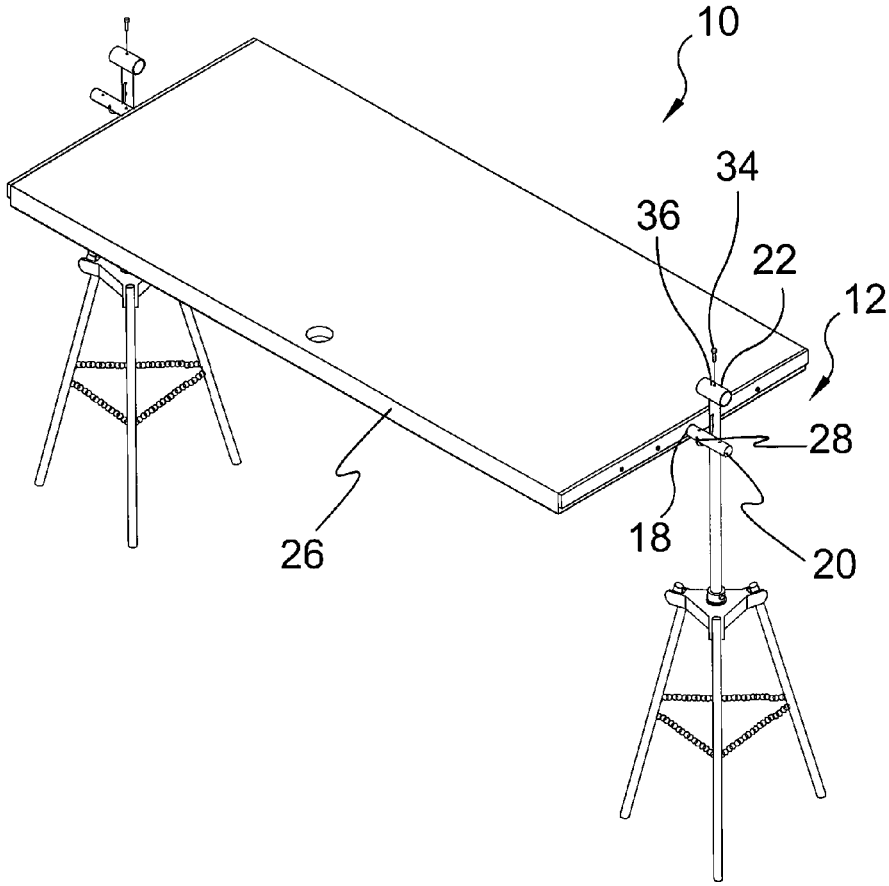
FIG. 6 is a perspective view of the present invention.

FIG. 6 is a perspective view of the present invention. Shown is the present invention 10 with the mounting posts 20 of the attachment brackets 18 suspended by the support hangers 28 of the holding stands 12 to enable a single user to easily and rapidly install the door 26 thereon by inserting one mounting post 20 into its respective mounting ring 22 and securing it therein by placing the locking pin 34 through the aligned locking pin apertures 36 of the post 20 and the ring 22 then following suit with the other holding stand 12.

Figure 7:
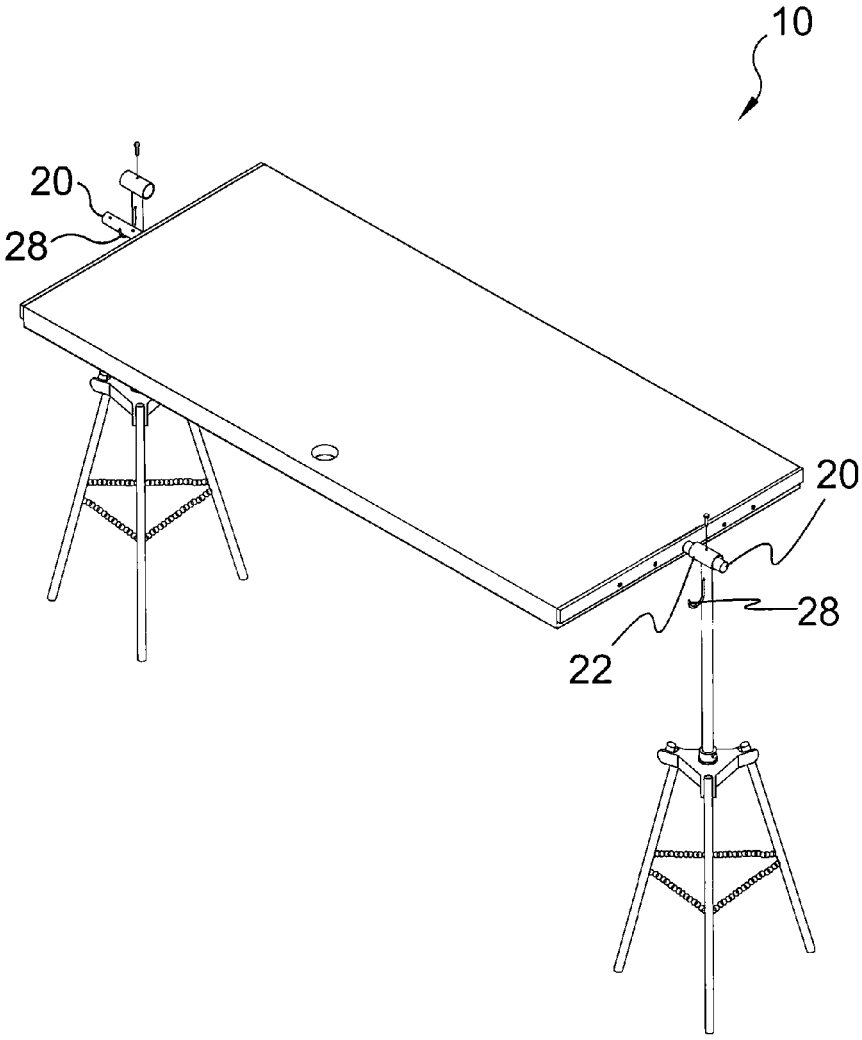
FIG. 7 is a perspective view of the present invention.

FIG. 7 is a perspective view of the present invention 10. Shown is the present invention 10 with the mounting post 20 on one side resting upon the support hanger 28 and the other mounting post 20 inserted into its respective mounting ring 22.

Figure 8:
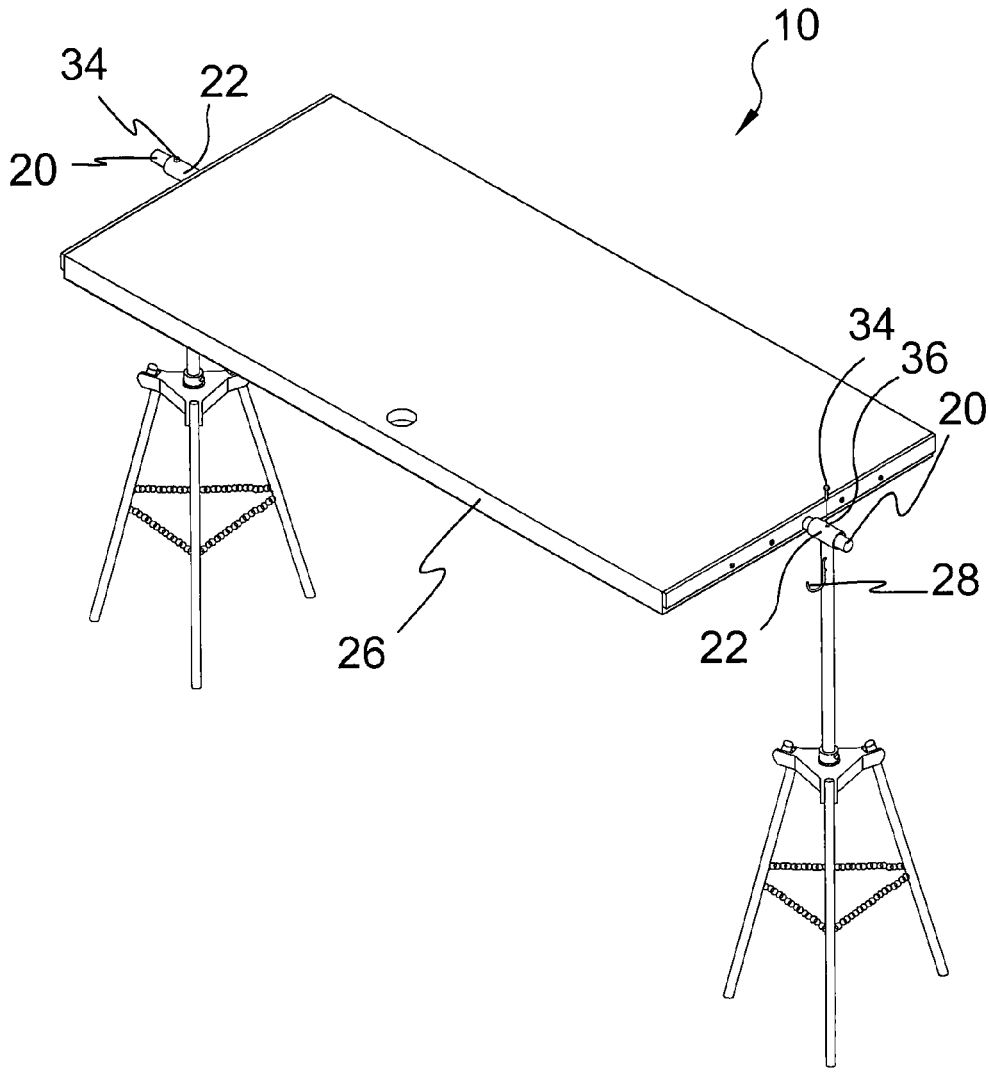
FIG. 8 is a perspective view of the present invention.

FIG. 8 is a perspective view of the present invention 10. Shown is the present invention 10 with each mounting post 20 removed from their support hangers 28 and inserted into their respective mounting rings 22. One locking pin 34 is installed into the aligned locking pin apertures 36 of its respective mounting post 20 and ring 22 and the other is ready to do so.

Figure 9:
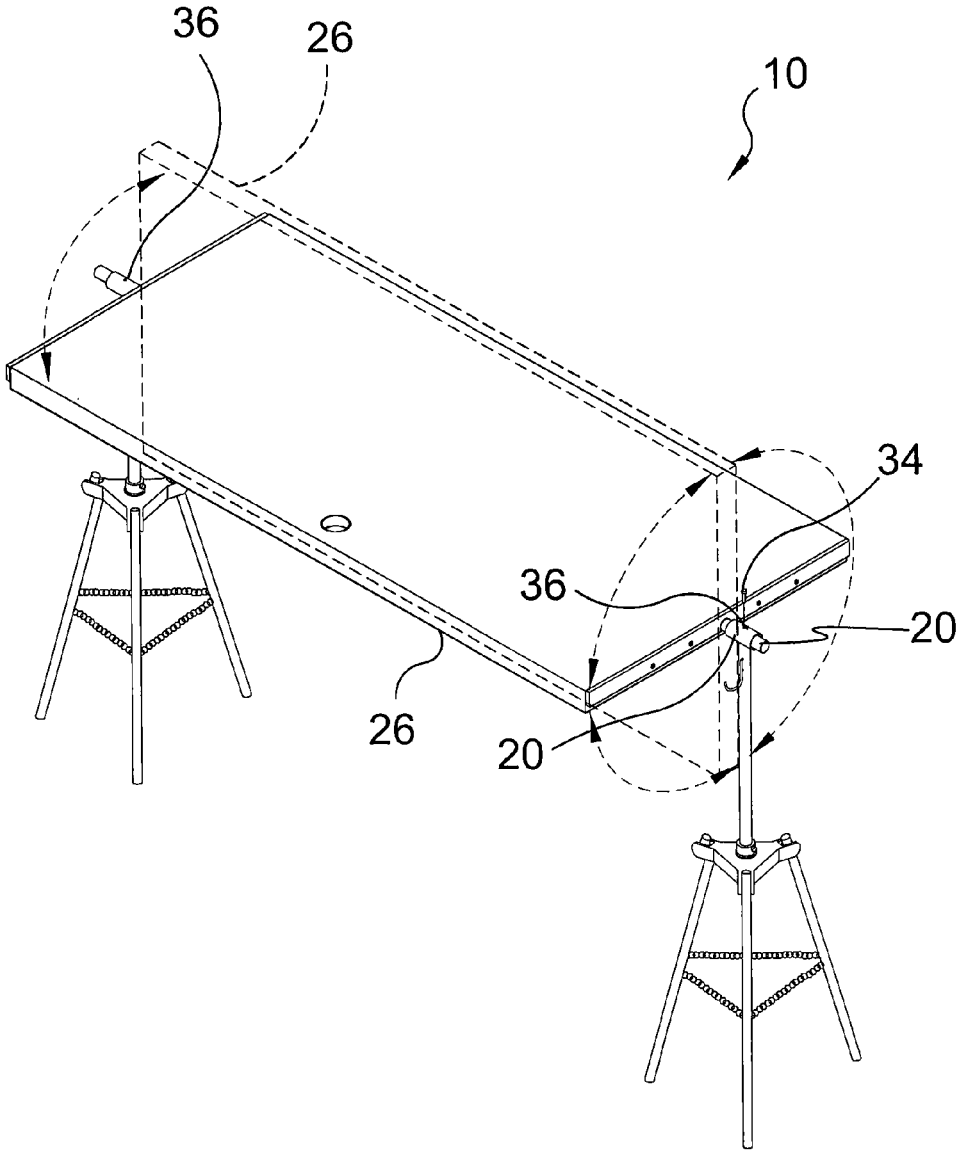
FIG. 9 is a perspective view of the present invention.

FIG. 9 is a perspective view of the present invention. Shown is the present invention 10 with both locking pins 34 removed from the apertures 36 in their respective mounting posts 20 and rings 22 thus enabling the user to freely and easily rotate the door 26 into another position without awkwardness or the need of a helper. Once a door 26 is installed to the stand, the door 26 can be rotated 360 degrees or as desired.

Figure 10:
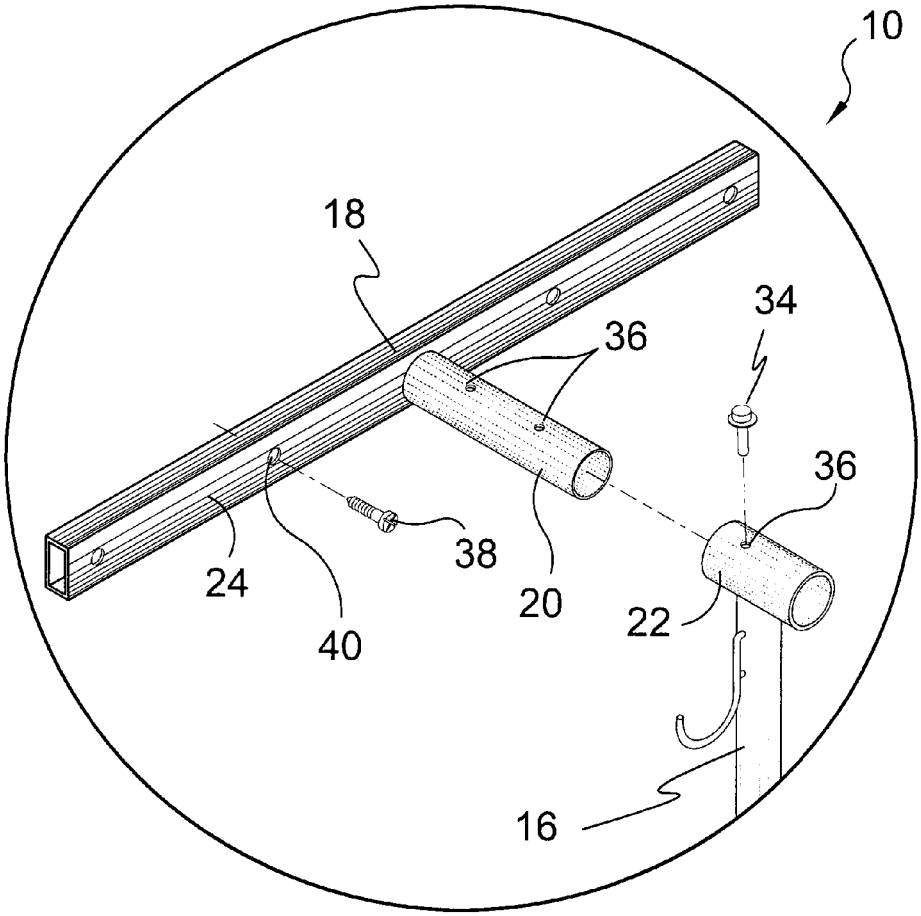
FIG. 10 is a detail view of the present invention.

FIG. 10 is a detail view of the attachment assembly of the present invention 10. The attachment bracket 18 comprises an elongate mounting plate 24 with a plurality of screw recesses 40 for receiving screws 38 that imbed to the top or bottom of a door and a centrally positioned mounting post 20 projecting from the mounting plate 24 away from the door. The mounting post 20 is rotatively installed into the mounting ring 22 disposed at the zenith of the stanchion 14. Rotation of the door is enabled and disabled by the user respectively removing or inserting the locking pins 34 into the aligned locking pin apertures 36 of the mounting post 20 and the mounting ring 22.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A rotative workpiece painter stand that enables the user to single-handedly install and suspend a workpiece and selectively rotate and lock it into position as needed, said painter stand comprising:

a) a pair of stand alone holding stands;

b) each said holding stand comprises:

a stanchion;

a tripod receiving a lower portion of said stanchion, said tripod having three divergent leg members that are spread for use and closed for transport and storage and further includes a locking collar and locking means through which said stanchion extends and retracts therethrough; and a mounting ring disposed at the peak of said stanchion and in perpendicular relation therewith;

c) a pair of mounting brackets that are removably secured to opposing sides of said workpiece, each said mounting bracket having a mounting post for rotatively supporting the mounting bracket from its respective mounting ring; and d) a support hanger disposed on a top portion of each said stanchion proximal to and inferior with said mounting ring, each support hanger for supporting its respective mounting post.

2. The rotative workpiece painter stand recited in claim 1, wherein each said mounting attachment bracket comprises:

a) a mounting plate having a plurality of screw recesses disposed therein to allow the passage of mounting screws therethrough; and b) each said mounting post projecting centrally from its respective mounting plate.

3. The rotative workpiece painter stand recited in claim 2, wherein said mounting post and said mounting ring have a plurality of corresponding, alignable apertures.

4. The rotative workpiece painter stand recited in claim 3, further including a locking pin for each mounting ring that is inserted into said apertures once aligned to restrict the further rotation of said mounting post within said mounting ring.

5. The rotative workpiece painter stand recited in claim 4, wherein said mounting brackets are installed on opposing sides of said workpiece with screws passing through said screw recesses of each said mounting plate and imbedded into said workpiece.

6. The rotative workpiece painter stand recited in claim 5, wherein said holding stands are placed upright with open tripod legs in a spaced-apart fashion to support said workpiece.

7. The rotative workpiece painter stand recited in claim 6, wherein said workpiece may be suspended from said mounting rings or said support hangers.

8. The rotative workpiece painter stand recited in claim 1, wherein said tripod locking collar and said stanchion further include corresponding locking pin apertures that are fixed in place with a locking pin.

* * * * *